United States Patent [19]

Verdouw

[11] 4,195,475

[45] Apr. 1, 1980

[54] RING CONNECTION FOR POROUS COMBUSTOR WALL PANELS

[75] Inventor: Albert J. Verdouw, Indianapolis, Ind.

[73] Assignee: General Motors Corporation, Detroit, Mich.

[21] Appl. No.: 862,858

[22] Filed: Dec. 21, 1977

[51] Int. Cl.[2] ..... F02C 3/00; F02C 7/12

[52] U.S. Cl. ..... 60/754; 60/746

[58] Field of Search ..... 60/39.65, 39.66, 39.31, 60/39.69, 39.36, 39.37; 431/352

[56] References Cited

U.S. PATENT DOCUMENTS

| | | | |
|---|---|---|---|
| 2,504,106 | 4/1950 | Berger | 60/39.69 |
| 2,785,878 | 3/1957 | Conrad | 60/39.69 |
| 2,837,893 | 6/1958 | Schirmer | 431/352 |
| 3,349,558 | 10/1967 | Smith | 431/352 |
| 3,736,747 | 6/1973 | Warren | 60/39.65 |
| 3,880,574 | 4/1975 | Irwin | 431/352 |

FOREIGN PATENT DOCUMENTS

| | | | |
|---|---|---|---|
| 1075063 | 10/1954 | France | 60/39.32 |
| 44-22564 | 9/1969 | Japan | 431/352 |

*Primary Examiner*—Carlton R. Croyle
*Assistant Examiner*—Thomas I. Ross
*Attorney, Agent, or Firm*—J. C. Evans

[57] ABSTRACT

A gas turbine engine combustor assembly of unique configuration has an outer wall made up of a plurality of axially extending multi-layered porous metal panels joined together at butt joints therebetween by a reinforcing and heat dissipation ring and a unique weld configuration to prevent thermal erosion of the ends of the porous metal panels at the butt joints; the combustor further including a unique inner wall made up of a plurality of like axially extending multi-layered porous metal panels joined at butt joints by a reinforcing and heat dissipation ring on the inner surface of the inner wall panels and an improved butt weld joint that prevents thermal erosion of the ends of the porous metal inner wall panels.

4 Claims, 3 Drawing Figures

RING CONNECTION FOR POROUS COMBUSTOR WALL PANELS

The invention described herein was made in the performance of work under a NASA contract and is subject to the provisions of Section 305 of the National Aeronautics and Space Act of 1958, Public Law 85-568 (72 Stat. 435; 42 U.S.C. 2457).

This invention relates to gas turbine engine combustor assemblies and, more particularly, to gas turbine engine combustors having porous liner segments forming the walls thereon.

Various proposals have been suggested for improving combustion in gas turbine engines by uniformly flowing combustion air into a combustion chamber through porous external liner portions of a combustor apparatus. Such arrangement produces transpiration coolant effects at the wall segments of the combustor liner.

Transpiration cooling is very efficient. This allows achievement of very low metal temperatures with a small amount of cooling air flow. The reduction in cooling air flow permits improvement of many combustor performance aspects while maintaining very uniform combustor skin temperature.

It is sometimes necessary to vary the porous material permeability along the combustor length. This results in a multi-segment combustor liner configuration. In such arrangements, it is necessary to join the segments by suitable fastener configurations to maintain structural integrity of the combustion apparatus without undesirably affecting the smooth flow of air from exteriorly of the combustor apparatus liner into the interior reaction chamber thereof. Furthermore, it is desirable to interconnect such structure through the axial extent of the combustor apparatus from the inlet of the outlet thereof by simple, easily assembled components which will join the sheets in limited space. A still more important objective of such an arrangement is to interconnect the separate segments of the liner wall so as to direct combustion air flow through all segments of the liner and more particularly at the point of the connector joint between combustor apparatus liner segments without blockage of air flow.

In U.S. Pat. No. 2,504,106, issued Apr. 18, 1950, wire screen having segments of different porosity between the inlet dome of the combustor to the transition outlet segment thereof are joined by connector strips that are lapped over adjacent end segments of the joined liner segments at a butt joint therebetween. In such arrangements, the connector sleeve has substantial extent that will reduce the inward flow of combustion air from a diffusion chamber around the combustion apparatus into its reaction zone. Accordingly, the combustor liner connection points can be subject to undesirable thermal erosion. The present invention obviates this problem by providing a unique butt joint arrangement that enables the joined liner panels to be connected one to the other without blocking flow of coolant air flow into the combustion zone at the point of connection.

An object of the present invention, therefore, is to provide an improved gas turbine engine combustor assembly having a plurality of porous metal wall segments joined at opposite ends thereof at butt connections formed in part by a reinforcing and heat dissipation ring and by a continuous connect weldment joining exposed ends of multi-layered porous metal material so as to avoid air flow restriction from the diffuser chamber of a combustor into the reaction zone thereof on either side of the butt connections.

Still another object of the present invention is to provide an improved combustor assembly having a combustor wall maintained at a selected temperature to prevent thermal erosion therein wherein the combustor includes a plurality of axially extending porous metal panels having end joint connections therebetween formed in part by a heat dissipating metal ring forming one wall of a weld region, the other wall being formed by exposed ends of the panels and with the weld region being filled by a weld formed continuously circumferentially around the joined panels and flush with the adjacent surfaces of the joined panels and wherein the metal ring serves as a heat sink for dissipating heat from the weld region to prevent undesirable thermal erosion thereof.

Still another object of the present invention is to provide an improved annular combustor having a plenum forming casing in surrounding relationship to an outer annular wall made up of a plurality of axial extending, separate, multi-layered porous metal panels joined at opposite ends thereof by butt joints defined by a combination heat dissipation and reinforcing ring and a continuously axially formed weldment joining exposed ends of the porous metal material; and wherein an axially inner wall of a combustor has a like plurality of axially extending, separate, multi-layered porous metal panels joined at butt joints therebetween formed by a heat dissipation and reinforcing ring and a continuously formed connect weldment that permits free flow of coolant from the diffuser chamber through the inner wall panels.

Further objects and advantages of the present invention will be apparent from the following description, reference being had to the accompanying drawings wherein a preferred embodiment of the present invention is clearly shown.

Figure 1:
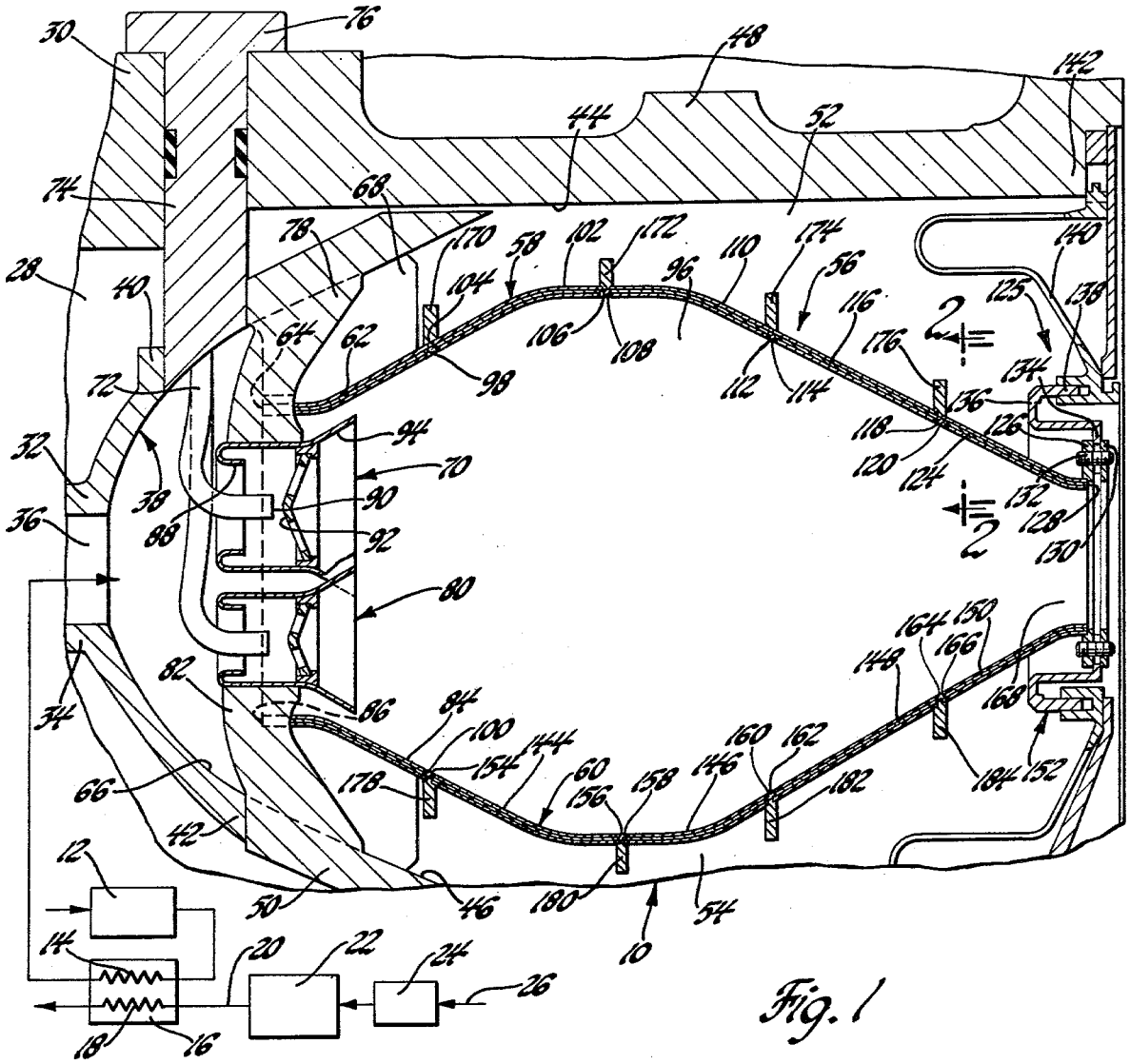
FIG. 1 is a longitudinal cross-sectional view showing a half section of a combustor apparatus constructed in accordance with the present invention.

Referring now to the drawing, a gas turbine engine combustor assembly 10 is illustrated in FIG. 1 associated with a diagrammatically shown gas turbine engine system including a compressor 12 for directing inlet air through the inlet pass 14 of a regenerator 16 that has an outlet pass 18 therefrom for receiving heated exhaust air from the outlet passage 20 leading from a power turbine 22 that is in communication with an inlet nozzle 24 leading from the outlet conduit 26 from the combustor assembly 10. This system is representative of known gas turbine engines for association with the present invention. The combustor assembly 10 of the present invention more particularly includes an annular end casing 28 including a radially outwardly directed flange 30 thereon. Casing 28 supports spaced walls 32, 34 defining an annular inlet 36 to an inlet air dome 38 with annular outer and inner flanges 40, 42 which merge with inner walls 44, 46 of annular outer case 48 and an annular inner case 50, respectively, that form an outer annular diffuser plenum 52 and an inner annular diffuser plenum 54 located radially outwardly and radially inwardly of a liner assembly 56 constructed in accordance with the present invention.

More particularly, the liner assembly 56 includes an outer wall 58 made up of a plurality of axially extended, multi-layer porous metal panels joined together at butt ends thereof. Likewise, the liner assembly 56 includes an inner wall member 60 made up of a plurality of axially extending panels joined at opposite butt ends thereof and each being made up of multi-layers of porous metal material. Examples of such material are set forth in U.S. Pat. No. 3,584,972 issued Jun. 15, 1971, to Bratkovich et al.

More particularly, the outer wall 58 includes an annular inlet segment or panel 62 that has an open end 64 aligned coaxially with an open end 66 of the inlet air dome 38. A plurality of radially inwardly directed struts 68 connect between the outer case 48 and the open end 64 to fixedly locate the outer wall inlet segment 62 radially outwardly of and circumferentially surrounding a plurality of circumferentially spaced air fuel injectors 70 which in the illustrated arrangement include a fuel pipe 72 supported by a fuel supply tube 74 having an outer flange 76 thereon supportingly received on the flange 32 and the outer case 48. Struts 78 also support injectors 70 from wall 48. Likewise, a second plurality of fuel injectors 80 are supported as a ring about inner wall 60 by a plurality of struts 82 between the inner case 50 and an inlet segment or panel 84 of the inner liner 60 at the open inlet end 86 thereof. Each of the fuel injectors 70, 80 are of the air blast type and include an axially inwardly bent inlet portion 88 located in surrounding relationship to the outlet end 90 of the fuel tube 72. The outlet end 90 is in alignment with a spray producing baffle 92 that disperses injected fuel into the air flow through the inlet air portion 88 so as to thoroughly mix air and fuel prior to passage from an outwardly flared diffuser segment 94 of the fuel injector 70, 80. In the illustrated arrangement, the inner ring of injectors 80 has a slightly smaller capacity than the outer ring of injectors 70 to produce a fuel/air spray pattern into a downstream reaction zone 96.

Each of the inlet panels 62, 84 are flared outwardly from their open end 64, 86, respectively, to diverge radially outwardly toward the outer case 48 and inner case 50. Panel 62 has an end 98 thereon. Likewise, the inner panel has an end 100 thereon. The next segment on the outer wall 58 is at 102 in FIG. 1. It has opposite ends 104, 106 thereon aligned, respectively, with the end 98 and a free end 108 on a next adjacent wall panel 110. It will be noted that the wall segment 102 diverges from the axis of the combustor toward the outer case 48 to the juncture between the ends 106, 108 where the next wall panel 110 diverges radially inwardly from the outer case 48 so that an end 112 thereon will be aligned with the free end 114 on a still more radially inwardly convergent wall panel 116 which has a free end 118 in alignment with the free end 120 of an outlet transition panel 124 of the outer wall 58. Panel 124 is carried by an annular support assembly 125 having support ring 126 welded to the end 128 of transition panel 124. The ring 126, nuts 130 and threaded pins 132 form a bracket that retains a slotted end 134 of an annular support ring 136 having an axial extension 138 thereon freely axially supported within a transition carriage assembly 140 supported to and dependent from the aft end 142 of the outer case 48.

Likewise, the inner wall 60 includes panels 144, 146, 148 with end portions in abutment with one another and with a transition segment 150 connected to a radially inwardly located annular support assembly 152 having parts corresponding to those shown on the outer annular support assembly 125. Panels 84, 144, 146, 148, 150 are flared symmetrically to the panels comprising the outer wall 58. Ends 100, 154 joins panels 84, 144. Panels 144, 146 are joined at ends 156, 158 thereon. Panels 146, 148 are joined at ends 160, 162 thereon and panels 148, 150 at their ends 164, 166.

By virtue of the aforedescribed arrangement, the reaction zone 96 has an expanded configuration from its inlet annulus up to a mid-point represented by the transition between the wall panels 102–110 of the outer wall 58 and the wall panels 144, 146 of the inner wall 60 and thereafter the combustion chamber reaction zone 96 is of decreasing annular volume to a reduced annular outlet opening 168 which leads to the inlet nozzle 24 of the turbine 22.

The fact that each of the wall panels is porous causes a controlled flow of air from the diffuser plenums 52, 54 into the combustion chamber. If desired, the porosity of given ones of the wall panels can be changed to suit local wall cooling requirements thereby to maintain uniform skin temperatures along the length of the combustor liner assembly 56.

Figure 2:
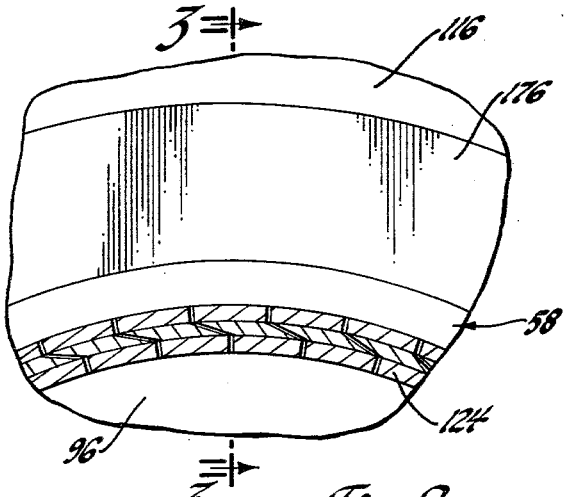
FIG. 2 is a fragmentary vertical sectional view taken along the line 2—2 of FIG. 1.

While the porous metal panels and the controlled air flow therethrough have an advantage from a combustion cooling standpoint, in some cannular applications of the type illustrated in FIGS. 1 and 2, such porous metal panels must also be reinforced to maintain structural integrity. The cans may also require dams and scoops for aerodynamic flow control. Accordingly, the present invention includes an improved arrangement for interconnecting the segments to one another at the inner and outer walls 60, 58 and to do so by means that will prevent hot spots in the material of the porous metal plates. Furthermore, it is accomplished by means of a reinforcing component that additionally serves as a means to dissipate heat at the panel joints. More particularly, looking at the outer wall 58, a plurality of axially spaced reinforcing rings 170, 172, 174, 176 are provided for connecting the abutting outer wall panels together. Likewise, a second plurality of reinforcing rings 178, 180, 182, 184 are provided to reinforce the inner wall 60. The reinforcing rings are formed continuously around the outer wall at axial spaced points thereon as are the reinforcing rings on the inner wall 60.

Each of the rings form part of an improved connector joint at each of the joined wall segments of both the inner and outer walls 60, 58. One such connector assembly is shown at 190 in FIG. 3. It includes an annular reinforcing ring; illustrated ring 176 is representative of all such rings. The reinforcing ring 176 has an upstream undercut shoulder 192 and a downstream undercut shoulder 194 seated respectively in the aft end 118 of the inlet panel 116 and the fore end 120 of the next adjacent downstream wall segment 124. Each of the wall panels 116, 124 are shown in this figure as including layers **116*a*, 116*b*, 116*c* of material and like layers 124*a*, 124*b* and 124*c*. The ends of layers 116*a* and 124*a* are seated tightly against a reduced width tang 196 which forms a continuous annular, radially outwardly directed wall 198 at the joint between the wall segment 116 and 124. The ends of the layers 116*b*, 116*c* and 124*b* and 124*c* diverge from one another to define a trapezoidally configured region in which weld material can be placed to form a weldment having a perimeter extent as shown in 200 in FIG. 3 and including an inside exposed surface of annular form 202 thereon that is flush with adjacent inner wall portions of layers 116*c* and 124*c***.

Figure 3:
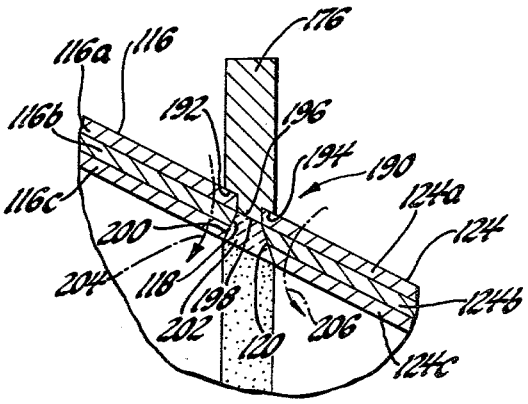
FIG. 3 is an enlarged sectional view of the section along line 3—3 of FIG. 2.

By virtue of the aforesaid arrangement, a joint is formed to couple the adjacent ones of the wall panels together and to do so by an arrangement that enables coolant air flow to pass through air passages in each of the multi-layers as shown by the arrows 204, 206 in FIG. 3 to maintain coolant flow to the reaction zone 96 in all regions of the joint but for the area of the weld itself.

Furthermore, any localized thermal erosion of the joint at the layers 115a–116c and 124a–124c is reduced since the weld transfers heat from the joint region into the tang 196 for conductive heat transfer to the reinforcing ring, ring 170 in FIG. 3, so as to continually remove heat from the connector assembly 190 to prevent undesirable thermal erosion thereat.

The other rings and connector assemblies are configured as the one representatively shown in FIG. 3. The avoidance of hot spots and maintenance of cooling air flow is accomplished by a panel connector design that minimizes weld joint width. Additionally, the porous fabricated sheet metal shown in FIG. 3 is easily piloted on the tang or base portion of the solid metal ring to simplify the interconnection of the parts to be joined by the weld. Moreover, the arrangement results in a smooth inner combustor wall surface to minimize cooling film disruption and minimize heat input to the combustor wall.

While the embodiments of the present invention as hereindisclosed, constitute a preferred form, it is to be understood that other forms might be adopted.

The embodiments of the invention in which an exclusive property or privilege is claimed are defined as follows:

1. A gas turbine engine combustor assembly comprising: an annular wall forming a combustion chamber, said annular wall having a plurality of axially directed panels, each of said panels including at least two or more laminated layers of porous material for directing fluid air flow from outside said liner to produce transpiration cooling of the inner surface of said segments in surrounding relationship to said combustion chamber, said panels each having axially spaced ends thereon, a combustor connector ring located in surrounding relationship to said ends on the outer surface of said panels, said ring including a locater tang thereon interposed between said ends in engagement therewith to maintain a controlled weld gap therebetween, a weld annulus of weld metal filling said weld gap to interconnect said ends, said weld annulus having an axial extent within the axial confines of said ring to minimize weld joint width and consequent reduction of flow of transpiration cooling air through said two or more laminated layers on either side of said annulus of weld metal, said weld annulus serving as a heat conductor for transfer of heat to said ring and thence exteriorly of said combustor so as to prevent hot spots in said weld annulus.

2. A gas turbine engine combustor assembly comprising: an annular wall forming a combustion chamber, said annular wall having a plurality of axially directed panels, each of said panels including at least two or more laminated layers of porous material for directing fluid air flow from outside said liner to produce transpiration cooling of the inner surface of said segments in surrounding relationship to said combustion chamber, said panels each having axially spaced ends thereon, a combustor connector ring located in surrounding relationship to said ends on the outer surface of said panels, said ring including a locater tang thereon interposed between said ends in engagement therewith to maintain a controlled weld gap therebetween, a weld annulus of weld metal filling said weld gap to interconnect said ends, said weld annulus having an axial extent within the axial confines of said ring to minimize weld joint width and consequent reduction of flow of transpiration cooling air through said two or more laminated layers on either side of said annulus of weld metal, said weld annulus having a smooth internal surface substantially flush with the internal surface of said segments to maintain a smooth inner combustor wall surface for minimal cooling film change, and said weld annulus serving as a heat conductor for transfer of heat to said ring and thence exteriorly of said combustor so as to prevent hot spots in said weld annulus.

3. A gas turbine engine combustor assembly comprising: an outer axial wall and an inner axial wall forming a combustion chamber therebetween, said outer axial wall having a plurality of axially directed panels, each of said panels including at least two or more laminated layers of porous material for directing fluid air flow from outside said liner to produce transpiration cooling of the inner surface of said segments in surrounding relationship to said combustion chamber, said panels each having axially spaced ends thereon, a combustor connector ring located in surrounding relationship to said ends on the outer surface of said panels, said ring including a locater tang thereon interposed between said ends in engagement therewith to maintain a controlled weld gap therebetween, a weld annulus of weld metal filling said weld gap to interconnect said ends, said weld annulus having an axial extent within the axial confines of said ring to minimize weld joint width and consequent reduction of flow of transpiration cooling air through said two or more laminated layers on either side of said annulus of weld metal, said weld annulus having a smooth internal surface substantially flush with the internal surface of said segments to maintain a smooth inner combustor wall surface for minimal cooling film change, and said weld annulus serving as a heat conductor for transfer of heat to said ring and thence exteriorly of said combustor so as to prevent hot spots in said weld annulus.

4. A gas turbine engine cannular combustor assembly comprising: an outer axial wall and an inner axial wall forming a combustion chamber therebetween, said outer annular wall and said inner axial wall each having a plurality of axially directed panels, each of said panels including at least two or more laminated layers of porous material for directing fluid air flow from outside said liner to produce transpiration cooling of the inner surface of said segments in surrounding relationship to said combustion chamber, said panels each having axially spaced ends thereon, a combustor connector ring located in surrounding relationship to said ends on the outer surface of each of said panels, said ring including a locater tang thereon interposed between said ends in engagement therewith to maintain a controlled weld gap therebetween, a weld annulus of weld metal filling said weld gap to interconnect said ends, said weld annulus having an axial extent within the axial confines of said ring to minimize weld joint width and consequent reduction of flow of transpiration cooling air through said two or more laminated layers on either side of said annulus of weld metal, said weld annulus serving as a heat conductor for transfer of heat to said ring and thence exteriorly of said combustor so as to prevent hot spots in said weld annulus.

* * * * *